United States Patent [19]

Mouissie

[11] Patent Number: 4,721,348

[45] Date of Patent: Jan. 26, 1988

[54] ELECTRICAL EDGE CONNECTOR FOR A SUBSTRATE

[75] Inventor: Bob Mouissie, Berlicum, Netherlands

[73] Assignee: E. I. Du Pont de Nemours and Company, Wilmington, Del.

[21] Appl. No.: 15,612

[22] Filed: Feb. 17, 1987

[30] Foreign Application Priority Data

Feb. 17, 1986 [NL] Netherlands ..... 8600397

[51] Int. Cl.[4] ..... H01R 9/09; H01R 13/629

[52] U.S. Cl. ..... 439/328; 439/630

[58] Field of Search ..... 339/75 MP, 176 MP

[56] References Cited

U.S. PATENT DOCUMENTS

| | | | |
|---|---|---|---|
| 3,188,598 | 6/1985 | Pferd | 339/17 LC |
| 3,970,353 | 7/1976 | Kaufman | 339/176 MP |
| 3,980,376 | 9/1976 | Rosen | 339/176 MP |
| 3,980,377 | 9/1976 | Oxley | 339/176 MP |
| 4,221,448 | 9/1980 | Logerot et al. | 339/176 MP |
| 4,469,389 | 9/1984 | Grabbe et al. | 339/75 MP |

FOREIGN PATENT DOCUMENTS

| | | | |
|---|---|---|---|
| 0163567 | 12/1985 | European Pat. Off. | 339/176 MP |
| 1391864 | 2/1975 | France . | |
| 4422981 | 9/1969 | Japan | 339/75 MP |

*Primary Examiner*—Gil Weidenfeld
*Assistant Examiner*—Gary F. Paumen

[57] ABSTRACT

An edge connector for electrically contacting a substrate. The substrate is held within connector housing by the force provided by a clamp means hingedly disposed within a cutout in the housing. The clamp means includes a spring portion, a clamp portion and a strike portion. The insertion of the substrate causes the clamp means through the action of all three portions to secure the substrate within the housing. The substrate can be released by hand.

8 Claims, 5 Drawing Figures

ELECTRICAL EDGE CONNECTOR FOR A SUBSTRATE

BACKGROUND OF THE INVENTION

1. Field of the Invention

The invention relates to an electrical edge connector for a substrate, and particularly to means for clamping together a substrate inserted into an edge connector.

2. Description of Related Art

Edge connectors for the external connection of conductors on, for example, printed circuit boards or on glass substrates of liquid crystal or LED (light emitting diode) display panels are widely used in electronic apparatus.

In many forms of construction, the holding power of an edge connector of this kind on the substrate is dependent solely on the number of contact members of the edge connector and their contact pressure on the substrate. The thickness of the substrate, the coefficient of friction between on the one hand a contact surface of the contact member and, on the other hand, a conductor of the substrate, and the coefficient of friction between a surface of the substrate and a pressure surface of the contact member, for example a spring arm, are usually important factors in this respect.

In many cases, high contact pressure will not be possible because the force required to push the connector over the edge of the substrate would then be too great. If the force required for this purpose is too great, the conductors on the substrate, which in many cases are in the form of thin strips, can in fact easily be damaged. The edges of glass substrates, for example, of liquid crystal display panels, are in addition very vulnerable, so that these edges can easily be damaged if too much force is used for their connection.

On the other hand, a powerful force is required for holding the edge connector on the substrate in applications where the substrate is subject to jolts, shocks or the like. This may for example be the case when the assembly is used in aircraft, ships or motor vehicles.

Because of these conflicting requirements for high contact pressure for holding power on the one hand, and smaller forces for making the electrical connection, on the other hand, it may be necessary to use an additional clamping means to eliminate accidental detachment of the edge connector from the substrate.

SUMMARY OF THE INVENTION

The invention solves this problem by providing a novel clamp means for use in a substrate-edge connector assembly. In the rest position, wherein the edge connector and the substrate are separated, the clamp means has no noteworthy effect on the force required for pushing-on the edge connector, but comes into action automatically when the edge connector is pushed onto the substrate, in such manner that in the position in which the edge connector is mounted on the substrate the clamp means provides the substrate-edge connector assembly with an additional holding force.

For this purpose, the invention is characterized in that the clamp means, which is to be hingedly connected to an edge connector, comprises a spring portion, a strike portion and a clamp portion, which are adapted to cooperate with one another in such a manner that through the action of the spring portion the clamp portion can assume a position of rest in which the clamp means applies no clamping action and does not hinder the insertion of the substrate into the edge connector. The invention is further characterized in that the strike portion is so shaped that against the action of the spring portion the strike portion can be moved by an edge of the substrate from the position of rest to the clamping position in which the clamp portion adds a holding force to the connection of the edge connector to the substrate.

In a preferred form of construction of a clamp means according to the invention, the spring portion is S-shaped, one of its ends serving as the sole hinge point, while the other end merges into a cross connecting member of which one end serves as the clamp portion of the clamp means and the other end is bent over approximately at a right angle to form an extended arm serving as the strike portion of the clamp means. This clamp means can be manufactured in a simple manner and inexpensively from a piece of resilient material.

One form of construction of a substrate-edge connector assembly, in which a clamp means according to the embodiment just described is used, is characterized in that the clamp means is hingedly enclosed in an appropriate cutout which is formed in the casing of the edge connector and which is open at the top. The S-shaped spring portion of the clamp means being received in the cutout, while the strike portion in the form of an extended arm projects outwards at the open top of the cutout. The clamp portion is in the form of a rounded boss projecting forwards. The hinge point of the spring portion is held in an opening formed in the rear wall of the cutout and against a support surface inside the cutout. The front wall of the cutout has an opening at the bottom so that the spring portion has an adequate spring travel and the clamp means can thus operate both in the horizontal and in the vertical direction. The casing of the edge connector is provided with a raised portion which is adapted to cooperate with the extended arm in such a manner that when the substrate is inserted, its edge can move the arm from the position of rest over the raised portion into the clamping position in which the arm is secured behind the flat side of the raised portion, while the additional holding force is created by the frictional force between the boss of the clamp means and a surface of the substrate against which the boss is pressed, from which position the clamp means can be returned by hand to the position of rest.

Instead of adding a holding force in the form of a frictional force between the clamp portion of the clamp means and a surface of the substrate, which will have to be done principally in the case of glass substrates of, for example, liquid crystal display panels, the additional holding force can also be obtained with the aid of a so-called pin-and-hole connection. It is, however, a prerequisite in this case that it should be possible to provide a hole in the substrate, which is for example the case with printed circuit boards.

In another preferred form of construction of a substrate-edge connector assembly according to the invention, the boss of the clamp means is for this purpose provided with an outwardly projecting pin adapted to cooperate with a hole formed in the surface of the substrate. On insertion of the substrate, the pin engages in the hole, and the resulting pin-and-hole connection remains held in the clamped position, so that the additional holding force provided for the substrate-edge connector assembly also comprises this pin-and-hole connection in addition to a frictional component.

In another preferred embodiment, the clamp means consists of two separate parts. One forms the spring portion having a shape bent over backwards from a hinge end, while its rounded portion serves as clamp portion of the clamp means. The other part is in the form of an extended arm of a pivoted lever lying against the spring portion and forms the strike portion of the clamp means.

A form of construction of a substrate-edge connector assembly in which a clamp means of this kind is incorporated is characterized in that the clamp means is hingedly enclosed in an appropriate cutout formed in the casing of the edge connector. This cutout is open at the top and contains the spring portion of the clamp means. One end of the spring portion bears internally against the front wall, while its hinge point is received in an opening provided in the front wall and the bottom of the cutout. The strike portion in the form of an extended arm of the lever projects outwards at the open top of the cutout. The hinger point of the lever is situated on the transition between the approximately vertically extended arm and the other bent end of the lever and is received in a cutout formed in the rear wall. On the casing of the edge connector, a raised portion is provided which is adapted to cooperate with the extended arm in such a manner that on the insertion of the substrate, the edge of the latter can move the arm from the position of rest over this raised portion into the clamping position in which the arm is secured behind the flat side of the raised portion. The additional holding power is created by the frictional force between a surface of the substrate and the rounded portion of the spring portion, which through the action of the bent end of the lever is pressed against the surface of the substrate, from which position the clamp means can be returned by hand to the position of rest.

The position where the contact means is hingedly connected to the edge connector may be higly dependent on the construction of the edge connector. The simplest and most effective form of construction will in general be characterized by the mounting of a clamp means on each of the two shorter sides of the the casing of the edge connector. However, if the substrate does not project laterally at at least one shorter side of the edge connector, one or more clamp means may also be displaced inwards with respect to the shorter sides of the edge connector, for example being situated in the middle of the edge connector.

BRIEF DESCRIPTION OF THE DRAWINGS

The invention will now be further explained in connection with examples of embodiments which are illustrated in the drawings, in which.

Figure 1:
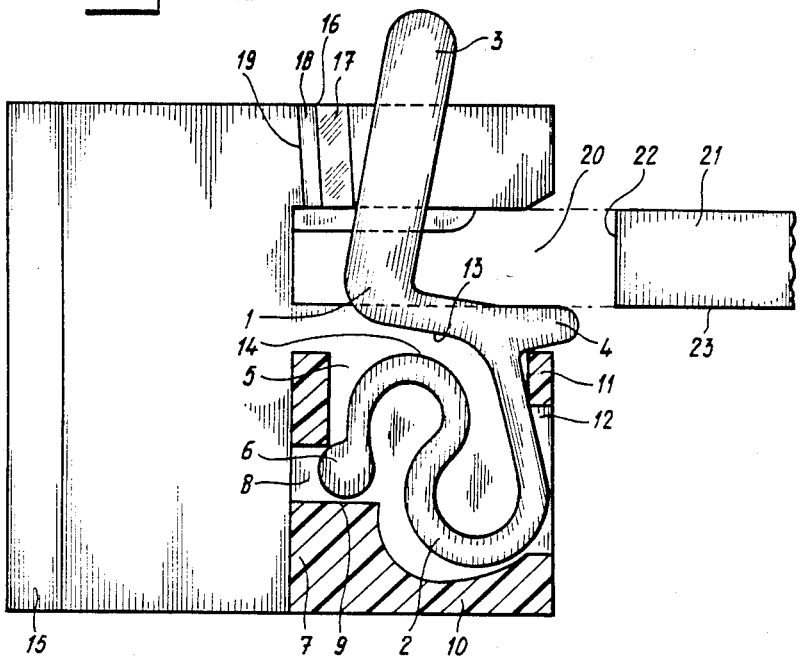
FIG. 1 is a cross-section of an embodiment of clamp means according to the invention, which is hingedly connected to an edge connector.
Figure 3:
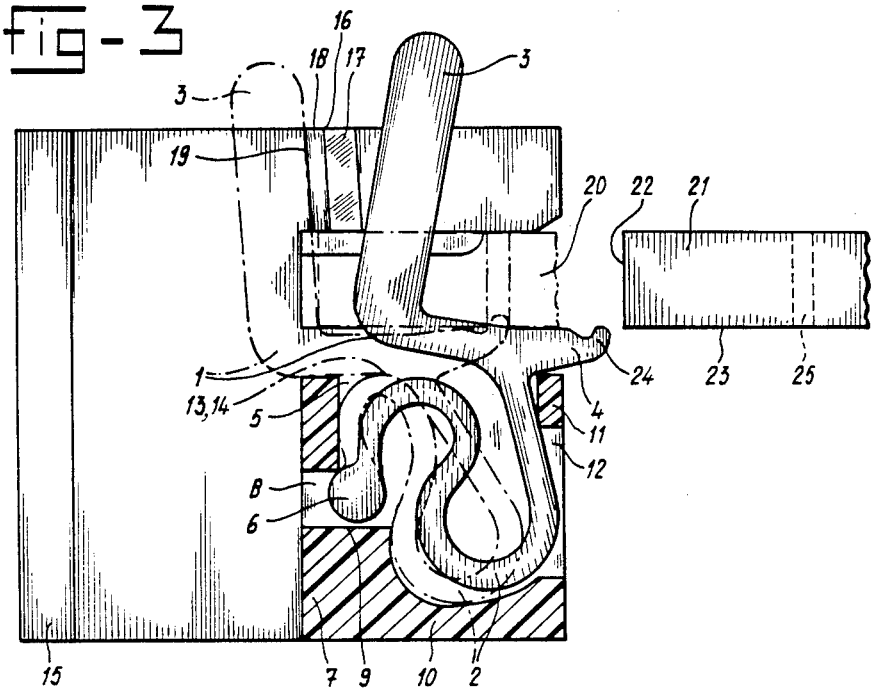
Figure 4:
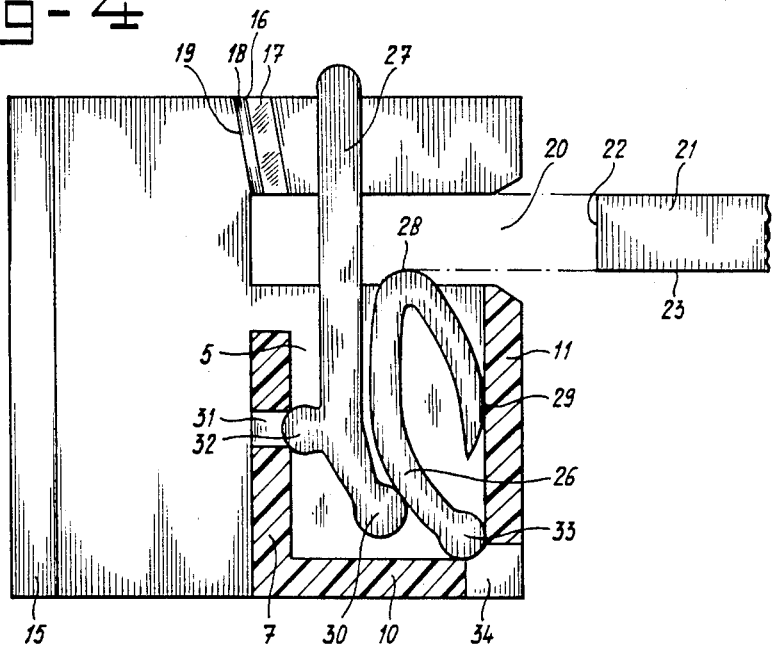

FIGS. *2a* and *2b* show in perspective a substrate-edge connector assembly provided with clamp means of the kind shown in FIG. 1, mounted on a shorter side of the edge connector;

FIG. 3 shows another preferred embodiment of the clamp means shown in FIG. 1, and FIG. 4 is a cross-section of the second preferred embodiment of the clamp means according to the invention, which is hingedly connected to an edge connector.

DESCRIPTION OF THE PREFERRED EMBODIMENTS

In the embodiment shown in FIG. 1, the clamp means 1 is a single, flat piece which is hingedly enclosed in a cutout 5 formed in the housing of an edge connector 15. The cutout 5 is open at the top and is further bounded by the rear wall 7, the front wall 1 and the bottom wall 10. The clamp means has a spring portion 2 disposed in the cutout 5. The spring portion is S-shaped and a cylindrical, thicker end 6 which in conjunction with an opening 8 in the rear wall 7 and a support surface 9 forms the single hinge point of the clamp means. At the other, upwardly projecting end, the spring portion 2 forms a T-shape to merge into a connecting member extending roughly crosswise to it. One end of the connecting member projects to the rear and forms an upwardly projecting, practically upright extended arm 3 lying roughly crosswise thereon, while the other end projects forwards and is slightly bent obliquely upwards and is provided with a rounded boss 4. The extended arm 3 forms the strike portion of the clamp means, while the boss 4 forms the clamp portion. The bottom well 10 of the cutout 5 is adapted internally to the round shape of the spring portion 2. An opening 12 is formed in the front wall 11.

The S-shape of the spring portion 2, the single hinge point, and the internal shape and openings of the cutout 5, ensures that adequate spring travel is provided, so that the spring can act in both the horizontal and the vertical direction.

FIGS. *2a* and *2b* show the clamp means of FIG. 1, mounted on the shorter side of an edge connector 15. In FIG. *2a*, the clamp means is in the position of rest through the action of its own spring force. In this position, the receiving opening 20 is free to receive the substrate 21. In this position, the lower face of the boss 4 rests on the top surface of the front wall 11.

When the edge connector 15 is pushed onto the substrate 21, the edge 22 of the substrate will exert a rearwardly directed force on the upwardly projecting extended arm 3 of the clamp means. The arm will consequently be displaced along an oblique side 17 of a sideways projecting trapezoidal shaped, raised portion 16. For this purpose it is necessary for the arm 3 to have adequate flexibility and room to move in order to be able to make this short sideways movement. The forwardly projecting boss 4 of the clamp means is thereby moved upwards in the direction of the surface 23 of the substrate.

When the edge connector is then pushed further onto the substrate, the arm 3 is moved over the flat top 18 of the trapezoidal shaped, raised portion 16 projecting from a side of the connector 15 into the clamping position, as shown in FIG. *2b*. The arm 3 is secured in this position by the flat side 19 of the raised portion 16. The boss 4 is thus pressed against the surface 23 of the substrate. The resulting frictional force supplies the additional holding force for the substrate-edge connector assembly. The clamp means can be released in a simple manner from the locked position shown in FIG. *2b* by manually moving the arm 3 back over the raised portion 16 into the position shown in FIG. *2a*.

Owing to the fact that the clamp means has sufficient room to move and that the spring can act in two directions, any variations in thickness of the substrate which may occur can be taken without any reduction of the frictional force between the boss 4 and the surface 23 of the substrate. Accordingly, the force required for pushing the edge connector onto the substrate is not appreciably affected by the clamp means.

Figure 2A:
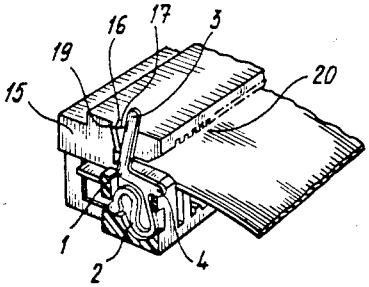
Figure 2B:
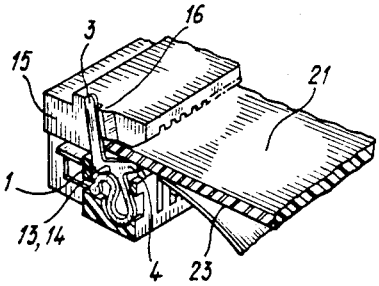

In the clamping position (FIG. 2*b*), the surface 13 of the connecting member lying roughly crosswise on the upwardly projecting end of the spring portion 2 can apply, depending on the thickness of the substrate, a downwardly directed force to the surface 14 of the spring portion 2. This further increases the spring action of the clamp means.

In the embodiment shown in FIG. 3, the boss 4 of the clamp means has attached to it a projecting pin 24, which fits into a blind hole 25 formed in the surface 23 of the substrate 21. The pin 24 is situated in such a manner that in the position of rest of the clamp means (FIG. 2*a*), the receiving opening 20 remains free to receive the substrate. The pin 24 and the hole 25 can cooperate in such a manner that when the edge connector is pushed onto the substrate, and the clamp means is moved into the clamping position, the pin 24 will engage in the hole 25 and in this way form a so-called pin-and-hole connection. The additional holding force supplied to the substrate-edge connector assembly then consists in this case of the frictional force between the boss 4 and the surface 23 of the substrate and the pin-and-hole connection formed. In this form of construction of the clamp means, the risk of accidental separation of the edge connector and the substrate through vibration, shocks and the like is very effectively reduced.

In another preferred embodiment, the clamp means consists of two separate parts: a lever 27 and a spring portion 26, as shown in FIG. 4. The lever 27 is provided on its forwardly obliquely bent lower face with a first cylindrical thickening 30, which cooperates with spring portion 26 which is made of resilient material and which is bent over backwards from the bottom side. The lever 27 is adapted to pivot about a rearwardly projecting second cylindrical thickening 32 cooperating with an opening 31 in the rear wall 7 of the cutout 5 formed in the housing of the edge connector 15. The extended, upwardly projecting and practically upright arm of the lever 27 forms the strike portion of the clamp means. The spring portion 26 can pivot on the cylindrical thickening 33 formed on one end, in conjunction with an opening 34 formed partly in the flat bottom 10 and partly in the front wall 11 of the cutout 5. The other end of the spring portion presses by its rounded side 29 against the inside of the front wall 11, and is adapted to slide vertically along this wall. The surface of the rounded part 28 of the spring portion 26 forms the clamp portion of the clamp means. The position of rest shown in FIG. 4 is taken through the action of the spring force of the spring portion, the receiving opening 20 being free to receive the substrate 21.

In the manner as that previously discussed, the extended arm projecting from the top of the cutout 5 and forming part of the lever 27 is moved from the position of rest to the clamping position when the edge connector is pushed onto a substrate. Through the rearwardly directed pressure against the extended arm of the lever 27, the thickening 30 will be moved forwards and compress the spring portion 26 against the action of its spring force. The surface of the rounded part 28 of the spring portion 26 will thereby be moved upwards and exert a pressure force against the surface 23 of the substrate. In the substrate-edge connector assembly provided with a clamping means in accordance with this embodiment the clamp means can be secured in the same way as was described above for the form of construction of the edge connector in which a one-piece clamp means is used.

The clamp means, and the different portions of the clamp means, are preferably made of flat spring strip material or of a resilient thermoplastic material.

It should be understood that the invention is not limited to the embodiments described above and shown in the drawings, but that modifications and additions are possible without going beyond the scope of the invention.

I claim:

1. An electrical edge connector for electrically contacting a substrate comprising:

a housing having a cutout open at the top, said cutout being defined by a rear wall, front wall and a bottom wall of the housing, a clamp means hingedly connected to said housing, said clamp means including a spring portion, a strike portion, and a clamp portion which are adapted to cooperate with one another, said spring portion being disposed in said cutout, said strike portion having an extended arm projecting outwards from the housing through the open top of the cutout, said clamp portion having a rounded boss projecting towards the front of the housing, one end of said spring portion being disposed in said housing cutout and being received at least partially in an opening formed in one of the walls of said housing, said one end serving as a hinge point for said clamp means, whereby through the action of the spring portion, the clamp is maintained in a rest position permitting the insertion of a substrate into the connector housing without hindrance from the clamp portion, and whereby as the substrate is inserted, an edge of the substrate abuts against said strike portion and moves said strike portion to cause said clamp means to move from the position of rest to a clamping position wherein said clamp portion exerts additional force on said substrate to hold it in the connector housing, and wherein said clamp means can be returned by hand to the position of rest from the clamping position by moving the extended arm.

2. An edge connector according to claim 1, wherein the spring portion is S-shaped, said one end of the S-shaped, spring portion serving as the sole hinge point, while the other end merges into a cross connecting member, one end of said cross connecting member serving as the clamp portion and the other end being bent over approximately at a right angle to form said arm serving as the strike portion of the clamp means.

3. An edge connector according to claim 1, wherein the clamp means comprises two separate parts, one of said parts forms the spring portion and has a shape bent over backwards from said hinge point, while a rounded portion of said bent over shape serves as the clamp portion of the clamp means, and the other of said parts is in the form of an extended arm of a pivoted lever lying against the spring portion and forms the strike portion of the clamp means.

4. An edge connector according to claim 2 wherein said clamp means are made of a theremoplastic material or of flat spring strip material.

5. An edge connector according to a claim 2, wherein said one end of the spring portion serving as the hinge point is held in an opening formed in the rear wall of the housing and against a support surface inside the housing, the front wall having an opening near the bottom, so that the spring portion has an adequate spring travel and the clamp means can thus operate both in the horizontal and in the vertical direction, the housing of the edge connector also having a raised portion which cooperates with the arm of the strike portion so that when the substrate is inserted, its edge can move the arm from the position of rest over the raised portion into the clamping position in which the arm is secured behind a flat side of the raised portion, the additional holding force being formed by the frictional force between the boss of the clamp means and a surface of the substrate against which the boss is pressed.

6. An edge connector according to claim 5, wherein the boss of the clamp means is provided with an outwardly projecting pin adapted to cooperate with a hole formed in the surface of the substrate so that on insertion of the substrate, the pin engages in said hole, and the resulting pin-and-hole connection remains held in the clamped position, thereby providing additional force for holding the substrate in the edge connector.

7. An edge connector according to claim 3, wherein said spring portion bears against the front wall, said one end of said spring portion serving as said hinge point is received in an opening provided in the housing where the front wall and the bottom wall meet, and the strike portion in the form of an extended arm of the lever projects outwards at the open top of the housing, said lever having a hinge point situated on the transition between the approximately upright extended arm and the other, bent arm of the lever, said lever hinge point being received in an opening formed in the rear wall, said housing further having a raised portion which is adapted to cooperate with the extended arm in such a manner that upon the insertion of the substrate, the edge of said substrate can move the arm from the position of rest over this raised portion into the clamping position in which the arm is secured behind a flat side of the raised portion, thereby providing additional holding force due to the frictional force between a surface of the substrate and the rounded portion of the spring portion, which through the action of the bent end of the lever is pressed against the surface of the substrate.

8. An edge connector according to claim 5, wherein the clamp means is mounted near a side of the edge connector housing.

* * * * *